US009080378B2

(12) United States Patent
Keller

(10) Patent No.: US 9,080,378 B2
(45) **Date of Patent: *Jul. 14, 2015**

(54) SUICIDE PREVENTION DEVICE

(71) Applicant: Patrick E. Keller, Virginia Beach, VA (US)

(72) Inventor: Patrick E. Keller, Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/102,371

(22) Filed: Dec. 10, 2013

(65) Prior Publication Data

US 2014/0144084 A1 May 29, 2014

Related U.S. Application Data

(63) Continuation of application No. 12/260,010, filed on Oct. 28, 2008, now Pat. No. 8,613,162.

(51) Int. Cl.

| | |
|---|---|
| ***E06B 7/28*** | (2006.01) |
| ***E06B 5/10*** | (2006.01) |
| ***E06B 1/52*** | (2006.01) |

(52) U.S. Cl.

CPC ... *E06B 7/28* (2013.01); *E06B 1/52* (2013.01); *E06B 5/10* (2013.01)

(58) Field of Classification Search

CPC ..... E06B 3/50; E06B 3/5054; E06B 3/7009; E06B 3/80; E06B 7/28; E06B 7/20; E06B 7/32; E06B 7/36; E06B 5/10

USPC ..... 49/501, 141, 163, 164, 165, 166, 168, 49/169, 170, 172, 173, 188, 189, 190, 191

See application file for complete search history.

(56) References Cited

U.S. PATENT DOCUMENTS

| | | | | |
|---|---|---|---|---|
| 1,273,520 | A * | 7/1918 | Millsaps | 49/168 |
| 4,924,214 | A * | 5/1990 | Hill | 340/666 |
| 7,024,823 | B2 * | 4/2006 | Keller | 49/399 |
| 7,999,690 | B1 * | 8/2011 | Shilts | 340/666 |
| 8,555,553 | B2 * | 10/2013 | Block et al. | 49/501 |
| 8,613,162 | B2 * | 12/2013 | Keller | 49/501 |
| 8,684,477 | B1 * | 4/2014 | Maresh | 312/292 |
| 2009/0293364 | A1 * | 12/2009 | Garstad et al. | 49/70 |
| 2011/0068927 | A1 * | 3/2011 | Berger | 340/573.1 |
| 2011/0273290 | A1 * | 11/2011 | Gilchrist | 340/545.1 |

FOREIGN PATENT DOCUMENTS

GB 2479745 A * 10/2011

* cited by examiner

*Primary Examiner* — Katherine Mitchell
*Assistant Examiner* — Catherine A Kelly
(74) *Attorney, Agent, or Firm* — Sheppard Mullin Richter & Hampton LLP

(57) ABSTRACT

A sentinel event reduction door comprises a trapazoidally-shaped panel comprising four sides. A continuous hinge is connected to the panel along substantially the full length of a first side thereof. A second side of the panel adjacent to the first side is at an angle defined by the inner section of the first and second sides of the panel and is an acute angle. A second panel at the top of the door for movement between an open position to a closed position within an opening in the second side of the first panel. A third side of the first panel has a pliable material attached thereto.

10 Claims, 1 Drawing Sheet

SUICIDE PREVENTION DEVICE

RELATED APPLICATIONS

The present application is a continuation of U.S. application Ser. No. 12/260,010, filed Oct. 28, 2008 and is entitled to priority based on that application. Applicant is the inventor of U.S. Pat. No. 7,024,823, the disclosure of which is hereby incorporated by reference in its entirety.

BACKGROUND OF THE INVENTION

Applicant's prior U.S. Pat. No. 7,024,823 discloses an effective suicide prevention device comprising a trapazoidally-shaped panel having two vertical sides, and an upper, slanted surface connecting the two vertical sides which is preferably at an acute angle to the longer of the two vertical sides so as to reduce or eliminate the physical means for a patient to hang him/herself. The bottom surface of the panel is also spaced from the floor. As described in U.S. Pat. No. 7,024,823, this device effectively reduces or prevents patients who are at risk for committing suicide from accomplishing such an act. However, the device of Applicant's prior patent does require a certain loss of privacy because of the opening above the top surface of the panel. This loss of privacy is particularly troublesome for patients because such panels are often used as bathroom doors.

Thus, although some degree of privacy was provided by the device of Applicant's previous patent, a need remained for a device that would provide increased privacy for a patient.

SUMMARY OF THE INVENTION

The present invention provides increased privacy combined with effective reduction or prevention of suicides, which are known in the industry as sentinel events. This is accomplished by adding a feature to the device described in Applicant's prior U.S. Pat. No. 7,024,823. This added feature is an additional panel at the upper end of the panel described in Applicant's previous patent, which additional panel is adapted to move downwardly if any attempt is made to use it as a purchase point for an instrumentality such as a belt, sheet, clothing, towel, etc. which might be used in an attempt to commit suicide by hanging.

Preferably, the main panel of the device of the present invention is provided with a hollow upper section adapted to receive the separate upper panel such that the upper panel can slide into and be received in its entirety within the main panel. In normal use, the upper panel will fill much of the space above the main panel, but the upper panel is coupled to the main panel by a connecting element which will release the upper panel when a specified amount of weight, e.g., five pounds, is applied to the upper surface of the upper panel. Thus, any attempt to use the upper panel as a hanging point will be defeated by the movement of the upper panel into the main panel whereby the slanted surface of the main panel will then perform its function of defeating the suicide attempt as described in Applicant's prior U.S. Pat. No. 7,024,823.

BRIEF DESCRIPTION OF THE DRAWINGS

FIG. 1C shows Small Flange 8.

DETAILED DESCRIPTION OF THE PREFERRED EMBODIMENTS

Figure 1B:
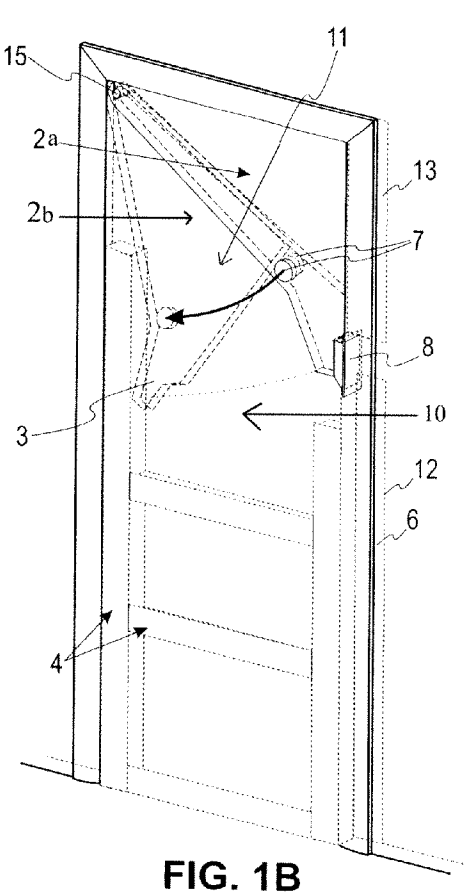
FIG. 1B is a view similar to FIG. 1A but which shows the drop down upper panel in the lowered position.
Figure 1A:
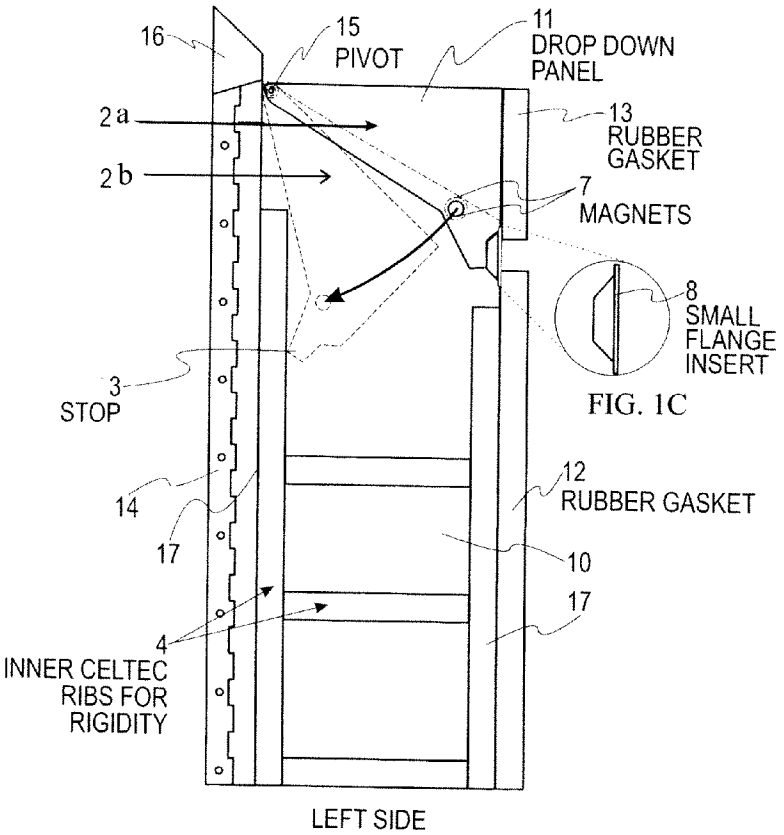
FIG. 1A demonstrates the device of the present invention with the upper drop down panel.

The suicide reduction and prevention system of the present invention includes a door having two panels and which is adapted to be hung in a door frame for use in facilities where there are patients who are at risk of hurting themselves or attempting suicide by hanging. The door is hung in any conventional door frame. The main portion or panel 10 of the door has an angled top and a continuous hinge 14. A second panel 11, which is movable with respect to the main panel 10, is also provided at the upper region of the main panel. Preferably, it is pivoted at 15 and drops down from position 2*a* to position 2*b* as shown in FIGS. 1A and 1B. The lower part 3 of panel 11 acts as a stop when panel 11 drops down. A pliable material is attached to the opposite side of the door from the hinge 14 side of the door. The door is preferably dimensioned so that there may be a substantial opening between the upper portion of the door and the upper portion of the door frame and possibly a substantial opening below the door and the floor if desired (not shown).

The suicide reduction door system is hung in a conventional door frame 6 (FIG. 1B) for use particularly in facilities where there are at-risk patients who may hurt themselves or attempt suicide. The door comprises a main section 10 which has a slot in the top of the door for receiving a pivotal top section 11 to collapse into and when approximately 5 pounds of vertical pressure is applied to the top of the door (such as in an attempted hanging). The top panel 11 collapses from upper space 2*a* into lower space 2*a* in the main section 10, and the top of the door now becomes a 60 degree slope in which the item being hung on the door falls to the floor. The door is made preferably of a pliable material called Celtec which is very durable and easy to disinfect. The door can be provided with inner rib 4, which may be vertical and horizontal, to provide added rigidity. The door system has a continuous hinge 14 that is angled as seen at the top 16. This angled feature eliminates hanging points which exist by use of normal hinges. The opposite side of the door from the hinge 14 has a pliable material 12 and 13, such as a rubber gasket, on both the main section 10 and the collapsible panel 11. The door can be dimensioned so there is an opening above and below the door between the door and door frame 6. The pliable material 12 and 13 provides two functions: one they hold the door in the closed position and second is they give privacy for the patient while using the bathroom. The door also has a separate piece 8 comprising a small material used on the door frame to cover the gap or an opening between the drop down panel 11 and the main door section 10 to thus give the patient further privacy particularly when the door replaces the usual standardized door found on most patient bathrooms. Objects such as clothing or linen can be wedged or tied to standard doors by patients used to hang oneself.

The suicide reduction door is mounted to the door frame 6 and can swing both ways, in and out. The upper drop down panel 11 is held normally in place by small magnets 7, one located inside the main section 10 of the door and the other on panel 11. If a patient attempts to hang anything on top of the door, this magnetic holder releases the panel 11 and allows the panel 11 to drop into the main section by moving from position 2*a* to position 2*b* as discussed before.

As mentioned above, in order to prevent wedging of objects between the side of the door opposite the hinge 14, an intentional gap of, for example 3 inches, is made during installation. The flexible gaskets 12 and 13 provide privacy and a means to hold the door in place. The gaskets grip the door frame and hold the door in place. A small flange 8 is mounted to the door frame 6 to cover the gap between the panel 11 and the main door section 10 to provide further privacy.

Preferably a wire cable is attached to the upper panel 11 and anchored inside the second panel 10. When the upper panel 11 is in the upright position, the wire cable is taut thereby preventing the upper panel 11 from coming out of the door.

What is claimed:

1. A collapsible door assembly comprising:

a body formed to include a cavity and a collapsible portion located above said cavity and configured to be capable of moving into said cavity, said collapsible portion being configured to transition between an uncollapsed state and a collapsed state in which it occupies said cavity, the top surface of said collapsible portion being approximately horizontal in the uncollapsed state and the top surface of the body being sloped such that the door assembly is configured so that it has no hanging points when the collapsible portion is in the collapsed state in said cavity, and a pressure sensor in contact with the collapsible portion which pressure sensor is configured to cause the collapsible portion to transition from the uncollapsed state to the collapsed state when a force which exceeds a predetermined amount is applied to the upper surface of said collapsible portion.

2. The collapsible door assembly of claim 1 wherein the top surface of said body is sloped at an angle between 40 degrees and 60 degrees from the vertical in the triggered state.

3. The collapsible door assembly of claim 1 wherein said predetermined amount is at least about five pounds.

4. The collapsible door assembly of claim 1 wherein said collapsible structure of claim 1 wherein said collapsible portion is provided with a stop member which limits the movement of the collapsible portion within the cavity in the body.

5. The collapsible door assembly of claim 1 wherein said body and said collapsible portion are substantially rigid.

6. A collapsible door assembly comprising:

a body formed to include a cavity and a collapsible portion located above said cavity and configured to be capable of moving into said cavity, said collapsible portion being configured to transition between an uncollapsed state and a collapsed state in which it occupies said cavity, the top surface of said collapsible portion being approximately horizontal in the uncollapsed state and the top surface of the body being sloped such that the door assembly is configured so that it has no hanging points when the collapsible portion is in the collapsed state in said cavity, and a pressure responsive element in contact with the collapsible portion which pressure responsive element is configured to cause the collapsible portion to transition from the uncollapsed state to the collapsed state when a force which exceeds a predetermined amount is applied to the upper surface of said collapsible portion.

7. The collapsible door assembly of claim 6 wherein the top surface of said body is sloped at an angle between 40 degrees and 60 degrees from the vertical in the triggered state.

8. The collapsible door assembly of claim 6 wherein said predetermined amount is at least about five pounds.

9. The collapsible door assembly of claim 6 wherein said collapsible structure of claim 1 wherein said collapsible portion is provided with a stop member which limits the movement of the collapsible portion within the cavity in the body.

10. The collapsible door assembly of claim 6 wherein said body and said collapsible portion are substantially rigid.

* * * * *